US006908662B2

(12) United States Patent
Pearce

(10) Patent No.: US 6,908,662 B2
(45) **Date of Patent: *Jun. 21, 2005**

(54) SQUEEZABLE CUSHIONS WITH RELIEF

(75) Inventor: Tony M. Pearce, Alpine, UT (US)

(73) Assignee: EdiZONE, LC, Alpine, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/164,832

(22) Filed: Jun. 7, 2002

(65) Prior Publication Data

US 2003/0228446 A1 Dec. 11, 2003

Related U.S. Application Data

(63) Continuation of application No. 09/932,393, filed on Aug. 17, 2001, now Pat. No. 6,865,759, which is a continuation-in-part of application No. 09/303,979, filed on May 3, 1999, now Pat. No. 6,413,458, which is a continuation-in-part of application No. 08/968,750, filed on Aug. 13, 1997, now Pat. No. 6,026,527, which is a continuation-in-part of application No. 08/783,413, filed on Jan. 10, 1997, now Pat. No. 5,994,450, which is a continuation-in-part of application No. 08/601,374, filed on Feb. 14, 1996, now Pat. No. 5,749,111.

(60) Provisional application No. 60/298,069, filed on Jun. 14, 2001.

(51) Int. Cl.[7] ..... B32B 3/20; A63B 39/00; A63B 43/02

(52) U.S. Cl. ..... 428/188; 428/131; 473/569; 473/571; 473/574; 473/596

(58) Field of Search ..... 428/131, 188; 5/654, 655.5; 473/571, 574, 596, 569

(56) References Cited

U.S. PATENT DOCUMENTS

| | | | | | |
|---|---|---|---|---|---|
| 3,884,466 | A | * | 5/1975 | MacDonald et al. | 473/571 |
| 3,942,202 | A | * | 3/1976 | Chevrolet | 5/689 |
| 5,133,550 | A | * | 7/1992 | Handy | 473/571 |
| 5,201,489 | A | * | 4/1993 | Wolf et al. | 248/638 |
| 5,253,866 | A | * | 10/1993 | Moorman et al. | 473/571 |
| 5,749,111 | A | * | 5/1998 | Pearce | 5/652 |
| 6,026,527 | A | * | 2/2000 | Pearce | 5/654 |

* cited by examiner

*Primary Examiner*—Donald J. Loney
(74) *Attorney, Agent, or Firm*—Daniel P. McCarthy; Parsons Behle & Latimer

(57) ABSTRACT

Grippable cushioning devices which may be used as cushions, squeezables, toys, throwable toys, and novelty items are disclosed. Some of those devices include holes therein which may provide a relief function in that the holes may buckle or collapse when squeezed. The holes may be generally parallel longitudinal columns which may permit air flow therethrough when the grippable cushioning device is thrown.

19 Claims, 4 Drawing Sheets

SQUEEZABLE CUSHIONS WITH RELIEF

CROSS REFERENCE TO RELATED APPLICATIONS

I hereby claim the benefit under Title 35, U.S.C. § 119(e) of a U.S. Provisional Patent Application filed on Jun. 14, 2001 and having Ser. No. 60/298,069. I hereby claim the benefit under Title 35 U.S.C. § 120 of each of the following: U.S. patent application Ser. No. 09/932,393 filed on Aug. 17, 2001, now U.S. Pat. No. 6,865,759, which is a continuation-in-part of Ser. No. 09/303,979 filed on May 3, 1999, now U.S. Pat. No. 6,413,458, which is a continuation-in-part of Ser. No. 08/968,750 filed on Aug. 13, 1997, now U.S. Pat. No. 6,026,527, which is a continuation-in-part of U.S. patent application Ser. No. 08/601,374 filed on Feb. 14, 1996, now U.S. Pat. No. 5,749,111, which is a continuation-in-part of Ser. No. 08/783,413 filed on Jan. 10, 1997, now U.S. Pat. No. 5,994,450, which claims priority to U.S. provisional patent application Ser. No. 60/021,019.

BACKGROUND OF INVENTIONS

Prior to the invention, there were already are a variety of cushions, squeezables, toys, throwable toys and novelties. Those devices failed to include the points of novelty of the inventions herein, however.

SUMMARY OF THE INVENTIONS

It is an object of the inventions to provide grippable cushioning devices. The devices may be used as cushions, squeezables, toys, throwable toys, and novelty items. Various structures and materials are disclosed that achieve this object. Further objects, features and advantage of the inventions will be found by persons of ordinary skill in the art upon reading the specification in light of the appended drawings.

DETAILED DESCRIPTION

U.S. Pat. Nos. 5,749,111; 6,026,527; pending U.S. patent application Ser. No. 09/303,979; and U.S. Provisional Patent Application Ser. No. 60/298,069; each of which is hereby incorporated by reference in its entirety, disclose various materials, structures and manufacturing methods which may be useful to persons interested in implementing some variations of the inventions disclosed herein. The reader is directed to those other references for information regarding materials and structures beyond that provided herein.

MATERIALS

The materials used may include low durometer elastomers, gels or other suitable materials. Examples of suitable materials are found in U.S. Pat. No. 5,994,450 which is hereby incorporated by reference in its entirety. An example formula for a soft gel useful for some of the inventions is as follows, in parts by weight:

- 10 parts Septon 4077 SEEPS tri-block copolymer, available from Kuraray of Japan
- 25 parts Duoprime 90 white paraffinic mineral oil available from Lyondell of Houston, Tex.
- 0.3 parts blaze orange aluminum lake pigment available from Day-Glo Corporation of Twinsburg, Ohio
- 0.1 parts Irgannox 1076 antioxidant available from Ciba Geigy of Basel, Switzerland Generally, thermoplastic gelatinous elastomers which can be used for making devices incorporating the inventions include an A-B-A triblock copolymer plasticized with a plasticizing agent. The A-B-A triblock copolymer could be SEEPS, SEPS, SEBS, or another polymer. The plasticizer could be oil, resin, rosin or another plasticizer. Ratios and additives may be adjusted to achieve desired performance. Polymers other than A-B-A triblock copolymers may be used as well.

Manufacture and molding (such as injection molding) of the materials is disclosed in the various patents cited by reference above, and the reader is directed to those patents for further reading. Generally the material is prepared first, placed into a mold, allowed to solidify, and removed from the mold.

In some embodiments, the gel tends to remain tacky which causes it to make fun noises as the ball is squeezed and released and holes re-open. As desired, the gel may be made more tacky in order to make balls or throwable devices easier to catch. It is within the scope of the inventions to vary the ratios of elastomer and plasticizer (oil) to achieve either firm/stiff or soft gel, depending on the particular application. For example, a hand squeezer for use by a patient after hand surgery should be quite soft, but a hand squeezer used by an athlete for strength building should be stiff.

PHYSICAL STRUCTURES

Figure 1A:
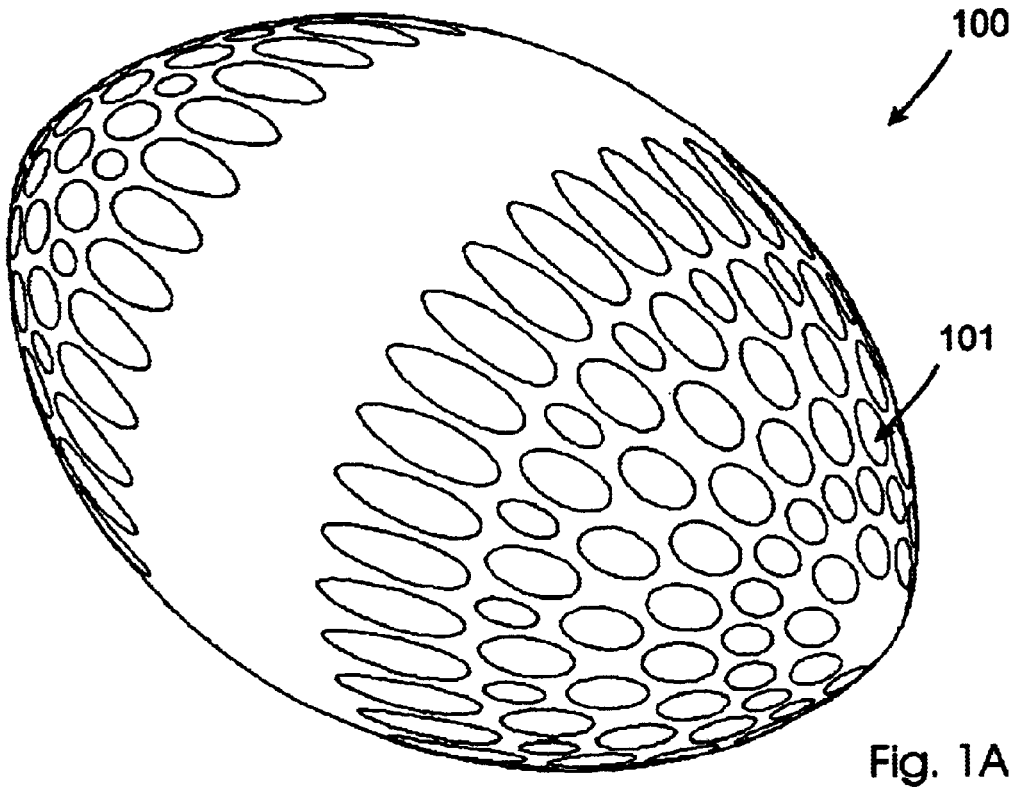
FIGS. 1*a* and 1*b* depict a perspective and cross sectional view of football, cushion, toy or squeezable using invented structures.
Figure 1B:
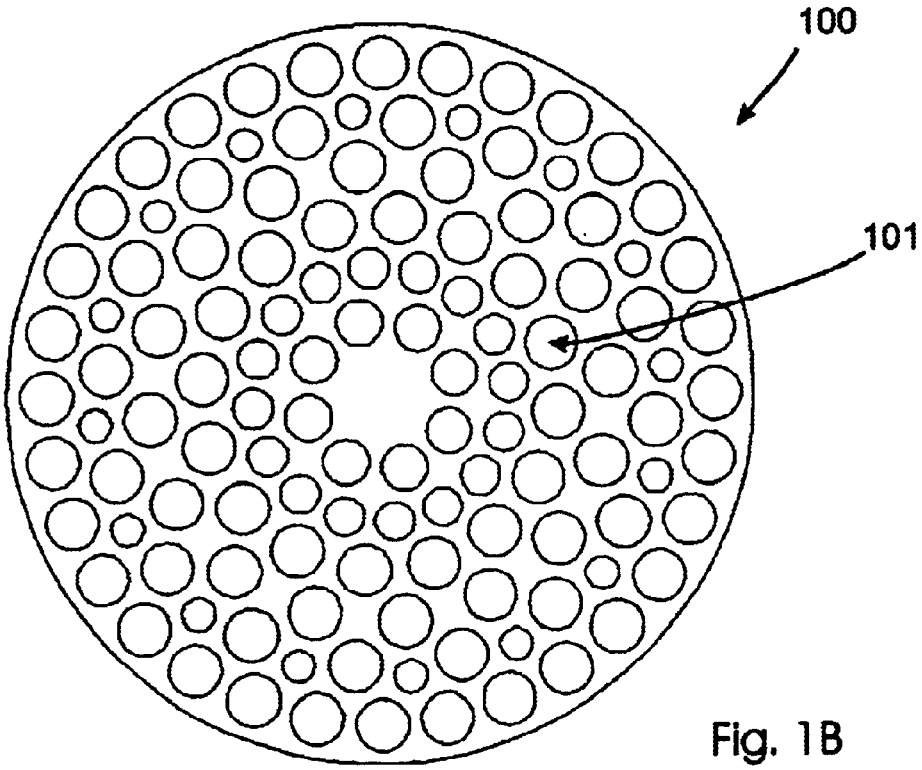

FIGS. 1*a* and 1*b* depict a perspective and cross sectional view of football, cushion, toy or squeezable using invented structures. The football 100 may be made from an elastomeric material, such as a gel that is generally non-flowable at room temperature, and may include a plurality of holes or columns 101 within its interior to provide the relief function described herein. Example dimensions of a football so constructed would be six inches from tip to tip. The user's fingers will tend to sink into the ball due to collapsing of the columns, making it easy to grip, throw and catch. This is especially important for small weak hands, such as in children, making sport accessible to them. The ball may or may not have a centrally located column, depending on the flight characteristics that the user desires. Depending on the column size, orientation and design, the ball may make a whistling noise in flight, delighting both the thrower and the receiver.

Figure 2A:
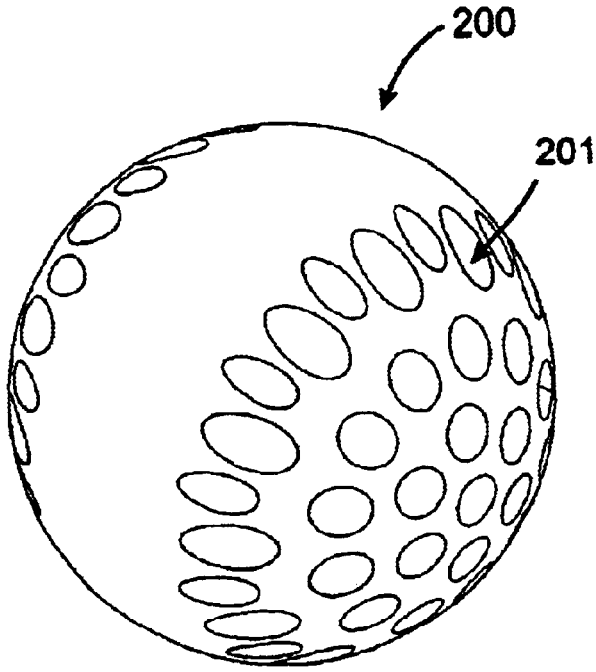
FIGS. 2*a* and 2*b* depict a perspective and cross sectional view of a spherical ball, cushion, toy or squeezable using invented structures.
Figure 2B:
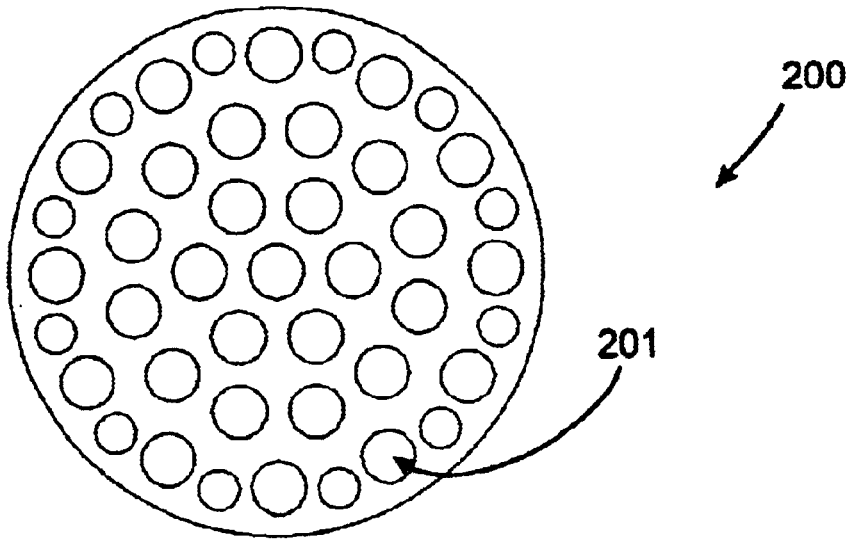

FIGS. 2*a* and 2*b* depict a perspective and cross sectional view of a spherical ball, cushion, toy or squeezable using invented structures. The ball 200 is made from a gel material and has a plurality of parallel columns, the longitudinal axes of the columns 201 being generally parallel to each other. Unique sporting games may be designed around these devices since they are so easy to throw and catch and tend to flatten on impact without breaking objects such as windows. Further, balls of this construction tend to have a flight of shorter distance than solid balls, making them excellent for practice in confined spaces. For example, backyard golf becomes possible with balls of the inventions. Non-traumatic and safe baseball can be played with balls of the inventions.

Figure 3A:
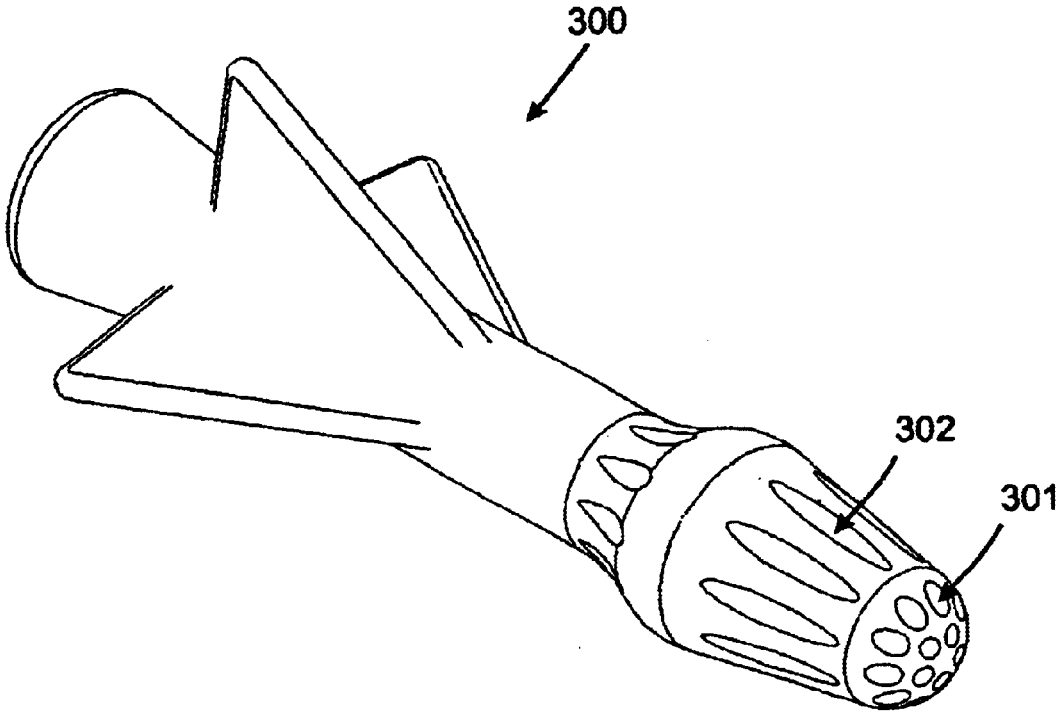
FIGS. 3*a* and 3*b* depict a perspective and cross sectional view of a rocket, cushion, toy or squeezable using invented structures.
Figure 3B:
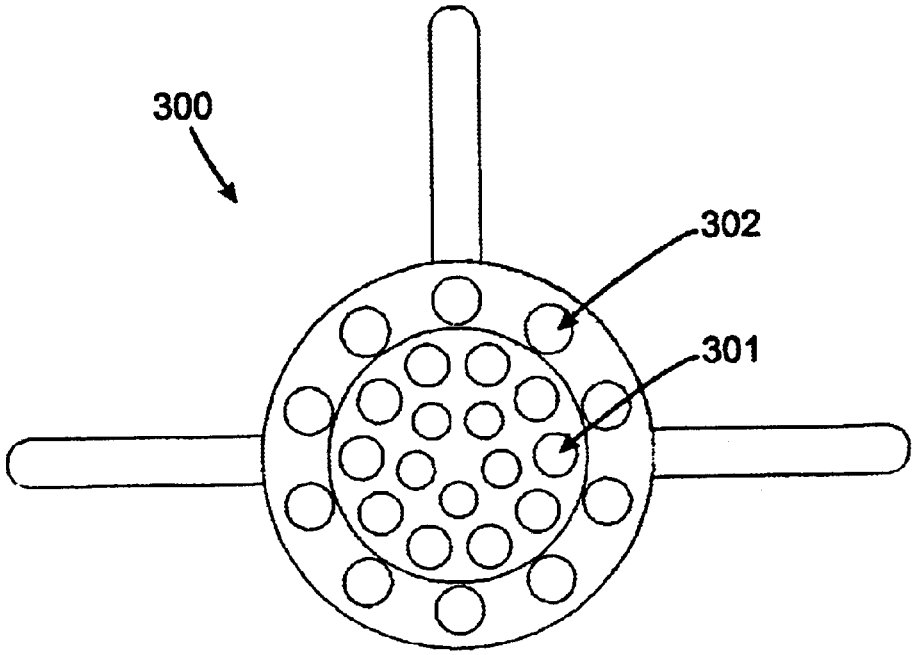

FIGS. 3*a* and 3*b* depict a perspective and cross sectional view of a rocket, cushion, toy or squeezable using invented structures. The rocket 300 includes a nose portion 302 with a plurality of generally parallel elongate hollow columns 302. As the nose includes the columns, the nose would tend to easily conform or demonstrate a relief function, so that if the rocket hits a fragile object, such as a window, energy of the rocket is absorbed during the deformation process and breakage of other objects is avoided. The rocket 300 has holes or columns along its entire length, although it is not depicted as having columns or holes in its wings or fins. Use of columns also lightens the device and reduces the amount of elastomeric material used and reduces cost. The rocket may be launched by a hand at high speed, but caught without hurting the hand due to the relief function of the columns. The rocket may also be stretched and shot much like a stretched rubber band. An optional finger hole (not shown) may be include to facilitate the forward end of the rocket while stretching the rear of the rocket. While stretching the back of the rocket is released and it is launched through the air.

Figure 4A:
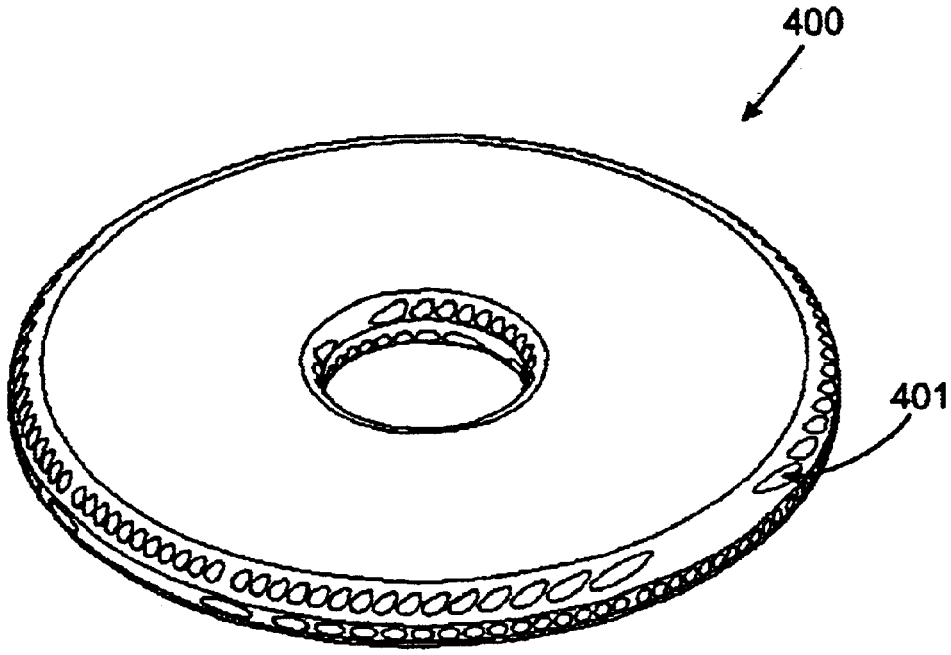
FIGS. 4*a* and 4*b* depict a perspective and cross sectional view of a throwable flying disk, cushion, toy or squeezable using invented structures.
Figure 4B:
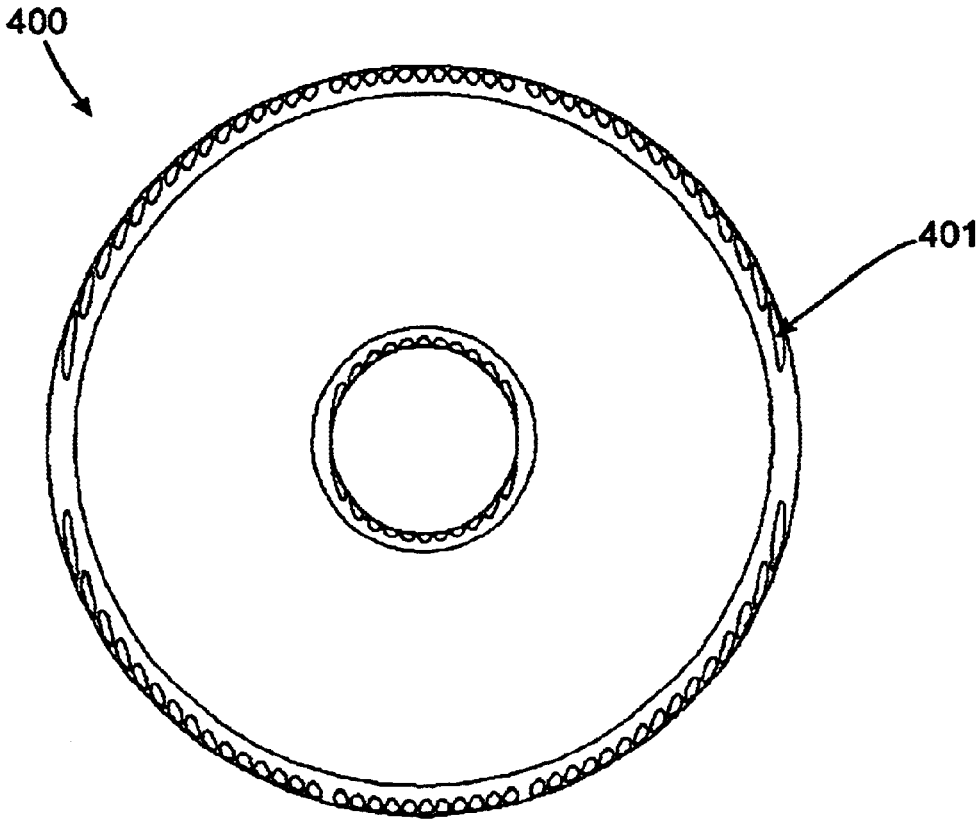

FIGS. 4*a* and 4*b* depict a perspective and cross sectional view of a throwable flying disk, cushion, toy or squeezable using invented structures. The flying disk 400 has a generally planar top and bottom, a central void or hold, a radiused outer periphery, and a plurality of relief columns or holes 401. The disk is very easy to throw and catch even by beginners, and whistles when it flies.

An important physical structure provided by the grippable cushioning devices of the inventions is relief. Relief is provided through the use of holes or columns in the material of the device. The holes or columns should be sufficient in size and arrangement to permit the elastomer material of the device to deflect or highly deflect under the force of contact with a user's body part. Relief allows a soft elastomer to move and re-shape to conform to the shape of an object that it contacts, but since the device has shape memory it will later return to its original shape. Use of an elastomer material means the device can be stretched or elongated without break. The holes used can be elongate and parallel or any other arrangements. The holes could also be air chambers within the device open to the outside so that there would be no gas pressure buildup within the device on squeezing or compression. The holes or columns may be designed as collapsing or buckling columns. A collapsing or buckling phenomena under load or pressure causes the device to be readily deformable and conformable. Some of the devices include generally parallel longitudinal columns which may permit air flow therethrough. In the case of a toy, such longitudinal columns may enhance flight performance.

The inventions may be implemented in any desired geometry, and the figures provide illustrative geometries only.

FUNCTIONS

The holes or columns used provide an opportunity for the elastomer to move out of the way in response to force applied by a user's body part, enhancing deformability, conformability and grippability of grippable cushioning devices. The devices can easily conform to the shape of a user's fingers and hand, for example, whether the user is manipulating the device for fun, stress relief, exercise, rehabilitation or otherwise. The conformability aspect of the device is especially important to cause the device to be grippable when thrown, caught or otherwise used. This permits persons playing sports to throw or catch the device in ball or other form under circumstances where it would not be possible to throw or catch a traditional solid or air-filled ball.

It is important to note that the device may be squeezed transverse to the longitudinal axis of the holes or columns. The parent cases mention columns that tend to buckle along their longitudinal axis. However, some of the cushions of the parent cases are not intended to be compressed transverse to the longitudinal axis of the columns. Various of the present inventions will perform well even if squeezed or deformed transverse to the longitudinal axis of the columns or holes.

The inventor has noticed that repeated squeezing and releasing of devices of the inventions can be captivating and calming, as well as providing direct physical benefits such as strength building. The sucking/clicking noises made by the holes in the gel during squeeze and release enhance this experience.

Important fictions which may be performed by some or all of the inventions include pressure equalization, shock absorption, local deformability, shape memory, conformability, vibration attenuation, conformable gripping surface, and others.

FIELDS OF USE

The inventions may be utilized in the fields of cushions for pressure relief, comfort cushions, support cushions, furniture cushions, mattresses, mattress overlays, wheelchair cushions, knee pads, sitting pads, surgical cushions, long term care cushions, cushions for the prevention or reduction of shock or vibration and damage, elbow pads, shin guards, sports pads, vibration attenuation and shock absorption pads for equipment such as stereo or scientific or engineering equipment, pads for running, hiking or work shoes, cushioning materials for packaging or shipping to prevent damage to goods, squeezables, toys, throwable toys, novelties, therapeutic squeezables for medical rehabilitation, squeezables for exercise or stress relief, sporting goods, balls, flying disks, launched or propelled objects, and any other object which may be squeezed, thrown, caught or which should be easy to grip or hold. Further, devices of the inventions may be shaped in the likeness of a cartoon character, famous person, family member, holiday figure, inanimate object, jack-o-lantern, etc.

While the present grippable cushioning devices have been described and illustrated in conjunction with a number of specific embodiments, those skilled in the art will appreciate that variations and modifications may be made without departing from the principles of the invention as herein illustrated, described, and claimed.

The present inventions may be embodied in other specific forms without departing from their spirit or essential characteristics. The described embodiments are to be considered in all respects as only illustrative, and not restrictive. The scope of the inventions are, therefore, indicated by the appended claims, rather than by the foregoing description. All changes which come within the meaning and range of equivalency of the claims are to be embraced within their scope.

What is claimed is:

1. A grippable cushion comprising:

a quantity of elastomeric polymer plasticized with a plasticizing agent to form a gelatinous elastomer material that is generally non-flowable at room temperatures, said gelatinous elastomer material being configured into the shape of a grippable cushion, said grippable cushion having an outer periphery and an inner portion said grippable cushion inner portion including said gelatinous elastomer material, said grippable cushion outer periphery being defined at least in part by said gelatinous elastomer material, said grippable cushion outer periphery being configured to enhance grippability by a human hand, a plurality of elongate hollow columns, at least some of said elongate hollow columns having a longitudinal axis, at least some of said elongate hollow columns' longitudinal axes being generally parallel to each other, a at least some of said elongate hollow columns being collapsible either along said longitudinal axis or transverse to said longitudinal axis in order to provide a relief function, said relief function including a quantity of said gelatinous elastomer material of the grippable cushion deflecting when the grippable cushion contacts a body part of a user under a sufficient contacting force, said relief function enhancing both grippability and conformability of the grippable cushion.

2. A grippable cushion as recited in claim 1 wherein said gelatinous elastomer is a thermoplastic.

3. A grippable cushion as recited in claim 1 wherein the grippable cushion has been made by an injection molding process.

4. A grippable cushion as recited in claim 1, the grippable cushion having a geometric center, at least one of said elongate hollow columns projecting through said geometric center.

5. A grippable cushion as recited in claim 1, the grippable cushion having a geometric center, and none of said elongate hollow columns projecting through said geometric center.

6. A grippable cushion as recited in claim 1, said grippable cushion outer periphery being generally spherical in shape.

7. A grippable cushion as recited in claim 1, said grippable cushion outer periphery being shaped generally like a ball.

8. A grippable cushion as recited in claim 1 wherein said elongate hollow columns are collapsible both along their longitudinal axes and transverse to their longitudinal axes.

9. A grippable cushion as recited in claim 1 wherein said elongate columns make an audible noise when forcibly and quickly collapsed and released.

10. A grippable cushion as recited in claim 1 wherein said elastomeric gel has shape memory.

11. A grippable cushion as recited in claim 1 wherein the grippable cushion may be stretched without break.

12. A grippable cushion as recited in claim 1 wherein said elastomeric gel is tacky, and wherein said tackiness enhances a user's grip on the grippable cushion.

13. A grippable cushion as recited in claim 1 wherein said elastomeric polymer is selected from the group consisting of SEPS, SEEPS and SEBS.

14. A grippable cushion as recited in claim 1 wherein at least some of said elongate hollow columns permit the flow of air therethrough.

15. A grippable cushion as recited in claim 14 wherein said air flow affects flight characteristics of the grippable cushion when thrown.

16. A grippable cushion as recited in claim 14 wherein the grippable cushion makes an audible noise when thrown.

17. A grippable cushion as recited in claim 1 wherein said elongate hollow columns are sufficient in size and arrangement to permit said gelatinous elastomer material to deflect when squeezed.

18. A grippable cushion as recited in claim 1 wherein at least some of said elongate hollow columns buckle when confronted with a sufficient force applied along their longitudinal axes.

19. A as recited in claim 1 wherein the grippable cushion provides at least one function selected from the group consisting of pressure equalization, shock absorption, local deformability, shape memory, conformability, energy absorption, vibration attenuation and conformance when gripped.

* * * * *